US011041220B2

(12) United States Patent
Yamamoto et al.

(10) Patent No.: US 11,041,220 B2
(45) Date of Patent: Jun. 22, 2021

(54) BLAST FURNACE OPERATION METHOD

(71) Applicant: JFE Steel Corporation, Tokyo (JP)

(72) Inventors: Naoki Yamamoto, Tokyo (JP); Akinori Murao, Tokyo (JP); Kota Moriya, Tokyo (JP); Nobuyuki Oyama, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 380 days.

(21) Appl. No.: 16/089,133

(22) PCT Filed: Mar. 23, 2017

(86) PCT No.: PCT/JP2017/011641
§ 371 (c)(1),
(2) Date: Sep. 27, 2018

(87) PCT Pub. No.: WO2017/170100
PCT Pub. Date: Oct. 5, 2017

(65) Prior Publication Data

US 2020/0299792 A1 Sep. 24, 2020

(30) Foreign Application Priority Data

Mar. 29, 2016 (JP) ..... JP2016-065402

(51) Int. Cl.
*C21B 5/00* (2006.01)

(52) U.S. Cl.
CPC ..... *C21B 5/003* (2013.01); *C21B 5/008* (2013.01)

(58) Field of Classification Search
CPC ..... C21B 5/00; C21B 5/003; C21B 5/008
USPC ..... 75/459
See application file for complete search history.

(56) References Cited

U.S. PATENT DOCUMENTS

2015/0008626 A1 1/2015 Omoto et al.
2015/0203929 A1 7/2015 Omoto et al.

FOREIGN PATENT DOCUMENTS

JP 04110405 A 4/1992
JP 06264122 A 9/1994
JP 09143526 A * 6/1997 ..... C21B 5/026
JP 2002194408 A 7/2002
(Continued)

OTHER PUBLICATIONS

NPL: online translation of JP-09143526-A, Jun. 1997 (Year: 1997).*
(Continued)

*Primary Examiner* — Jie Yang
(74) *Attorney, Agent, or Firm* — RatnerPrestia

(57) ABSTRACT

Provided is a blast furnace operation method that enables lowering of the reducing agent ratio of a blast furnace. The blast furnace operation method includes injecting pulverized coal through tuyeres of a blast furnace. The method includes adjusting coal containing moisture and volatile matter to form adjusted pulverized coal having a specific surface area within a range of 2 $m^2/g$ or more and 1000 $m^2/g$ or less, a lower heating value of 27170 kJ/kg or more, and a volatile matter content within a range of 3 mass % or more and 25 mass % or less. The method further includes injecting, through the tuyeres of the blast furnace, pulverized coal in which the adjusted pulverized coal, in a mixing ratio of 10 mass % or more, is mixed.

2 Claims, 1 Drawing Sheet

(56) References Cited

FOREIGN PATENT DOCUMENTS

| | | | |
|---|---|---|---|
| JP | 2003247007 | A | 9/2003 |
| JP | 2014031548 | A | 2/2014 |
| JP | 2014043605 | A | 3/2014 |
| KR | 101597716 | B1 | 2/2016 |
| RU | 2118989 | C1 | 9/1998 |
| UA | 87655 | U | 2/2014 |
| WO | 2016031653 | A1 | 3/2016 |

OTHER PUBLICATIONS

Chinese Office Action for Chinese Application No. 201780018503.3, dated Oct. 9, 2019 with Concise Statement of Relevance of Office Action, 9 pages.
Chinese Office Action for Chinese Application No. 201780018503.3, dated Mar. 25, 2020 with Concise Statement of Relevance of Office Action, 6 pages.
Chinese Office Action for Chinese Application No. 201780018503.3, dated Jun. 18, 2020 with Concise Statement of Relevance of Office Action, dated Jun. 18, 2020, 5 pages.
Extended European Search Report for European Application No. 17774641.9, dated Feb. 12, 2019, 7 pages.
Japanese Office Action for Japanese Application No. 2018-509164, dated May 21, 2019 with Concise Statement of Relevance of Office Action, 4 pages.
Korean Office Action for Korean Application No. 10-2018-7027930, dated Feb. 6, 2020 with Concise Statement of Relevance of Office Action, 4 pages.
Russian Office Action for Russian Application No. 2018134066, dated Jun. 19, 2019 with translation, 12 pages.
International Search Report and Written Opinion for International Application No. PCT/JP2017/011641, dated May 16, 2017—5 pages.
Korean Office Action for Korean Application No. 10-2018-7027930, dated Aug. 19, 2020, with Concise Statement of Relevance of Office Action, 6 pages.

* cited by examiner

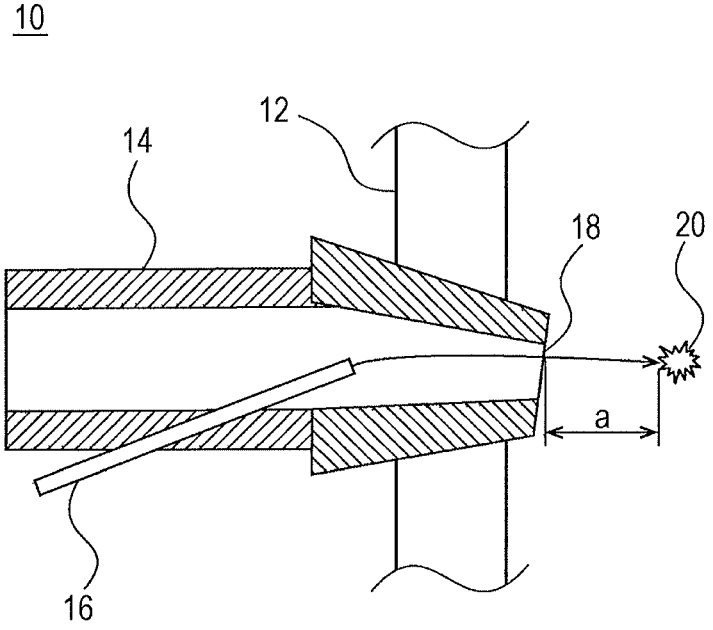
10
12
14
18
20
a
16

BLAST FURNACE OPERATION METHOD

CROSS REFERENCE TO RELATED APPLICATIONS

This is the U.S. National Phase application of PCT/JP2017/011641, filed Mar. 23, 2017, which claims priority to Japanese Patent Application No. 2016-065402, filed Mar. 29, 2016 the disclosures of these applications being incorporated herein by reference in their entireties for all purposes.

FIELD OF THE INVENTION

The present invention relates to a blast furnace operation method that involves injecting pulverized coal having an increased combustion temperature through tuyeres of a blast furnace and thus enables lowering of the reducing agent ratio.

BACKGROUND OF THE INVENTION

Global warming due to an increase in the amount of carbon dioxide gas emissions has been a problem in recent years, and inhibition of $CO_2$ emissions is an important task for the steel industry, too. In response to this, in blast furnace operations these days, operation with a low reducing agent ratio (low RAR, an abbreviation for Reducing Agent Ratio, which means the sum of the amount of a reducing agent injected through tuyeres and the amount of coke charged from the furnace top, per ton of pig iron produced) is being strongly promoted. Blast furnaces mainly use, as reducing agents, coke and pulverized coal, which is injected through tuyeres. Improving the combustibility of pulverized coal and thus reducing the use of coke is effective for achieving a low reducing agent ratio and in turn inhibition of carbon dioxide gas emission.

Patent Literature 1 proposes using coal having combustibility improved by adjusting the values of the oxygen atom content, average pore diameter, pore volume, and specific surface area of the coal to be injected to be within particular ranges and thereby reducing the amount of unburned carbon.

Patent Literature 2 proposes increasing the amount of heat generation of palm kernel shell charcoal (PKS charcoal) by subjecting it to a carbonization and pyrolysis process and increasing its specific surface area, thereby increasing combustibility, compared with pulverized coal of the related art. It is stated that the coke replacement ratio is thereby improved, compared with pulverized coal of the related art.

Patent Literature 3 proposes injecting combustion residues having a specific surface area of 70 $m^2/g$ or more, as measured after a combustion test is conducted on the combustion residues under conditions comparable to those for the blast furnace, and allowing the combustion residues, preferentially over coke, to react with $CO_2$, thereby reducing the amount of pulverized coal accumulated in the lumpy zone of the blast furnace.

Patent Literature 4 proposes injecting pulverized coal in which the proportion of particles having a particle diameter of 74 μm or less is 80 mass % or more and which has a specific surface area of 4500 $cm^2/cm^3$ or more to improve combustibility and thus reduce the amount of unburned carbon.

Patent Literature 1: Japanese Unexamined Patent Application Publication No. 2014-031548

Patent Literature 2: Japanese Unexamined Patent Application Publication No. 2014-043605

Patent Literature 3: Japanese Unexamined Patent Application Publication No. 04-110405

Patent Literature 4: Japanese Unexamined Patent Application Publication No. 2003-247007

SUMMARY OF THE INVENTION

None of Patent Literature 1 to 4 discloses increasing the combustion temperature of pulverized coal to be injected through tuyeres of a blast furnace. An object of the present invention is to provide a blast furnace operation method that enables lowering of the reducing agent ratio, which is achieved by obtaining pulverized coal having a high ignitability and a high combustion temperature by ensuring that the specific surface area, volatile matter content, and lower heating value of low-grade coal containing moisture and volatile matter are within particular ranges and injecting the pulverized coal through tuyeres of the blast furnace, thereby increasing the temperature within the blast furnace.

Features of the present invention for solving the problems described above include the following.

(1) A blast furnace operation method including injecting pulverized coal through tuyeres of a blast furnace, the method including adjusting coal containing moisture and volatile matter to form adjusted pulverized coal having a specific surface area within a range of 2 $m^2/g$ or more and 1000 $m^2/g$ or less, a lower heating value of 27170 kJ/kg or more, and a volatile matter content within a range of 3 mass % or more and 25 mass % or less and injecting, through the tuyeres of the blast furnace, pulverized coal in which the adjusted pulverized coal is mixed in a mixing ratio of 10 mass % or more.

(2) A blast furnace operation method including injecting pulverized coal through tuyeres of a blast furnace, the method including adjusting coal containing moisture and volatile matter to form adjusted pulverized coal having a specific surface area within a range of 110 $m^2/g$ or more and 8.00 $m^2/g$ or less, a lower heating value of 30000 kJ/kg or more, and a volatile matter content within a range of 4 mass % or more and 21 mass % or less and injecting, through the tuyeres of the blast furnace, pulverized coal in which the adjusted pulverized coal is mixed in a mixing ratio of 10 mass % or more.

Implementation of the blast furnace operation method of the present invention increases the combustion temperature of pulverized coal to be injected through tuyeres of a blast furnace. As a result, the temperature within the blast furnace is increased, which in turn lowers the reducing agent ratio of the blast furnace and reduces the amount of coke to be charged from the top of the blast furnace.

BRIEF DESCRIPTION OF THE DRAWINGS

The FIGURE is a partial schematic cross-sectional view of a combustion experiment apparatus 10.

DETAILED DESCRIPTION OF THE INVENTION

The present invention pays particular attention to the ignitability and combustion temperature of pulverized coal as an approach to further increase the temperature within a blast furnace by injecting pulverized coal through tuyeres of the blast furnace. That is, the ignitability of pulverized coal can be improved by ensuring that the specific surface area of pulverized coal to be injected through tuyeres of a blast furnace is within the range of 2 $m^2/g$ or more and 1000 $m^2/g$ or less, preferably within the range of 2.1 $m^2/g$ or more and 996.4 $m^2$ or less, and even more preferably within the range of 110 $m^2/g$ or more and 800 $m^2/g$ or less and ensuring that the volatile matter content of the pulverized coal on a dry basis is within the range of 3 mass % or more and 25 mass % or less, preferably within a range of 3.8 mass % or more and 24.8 mass % or less, and more preferably within the range of 4 mass % or more and 21 mass % or less. Furthermore, the combustion temperature of the pulverized coal during combustion can be increased by ensuring that the lower heating value is 27170 kJ/kg or more, preferably 27183 kJ/kg or more, and even more preferably 30000 kJ/kg or more. By injecting adjusted pulverized coal adjusted to be within the ranges described above through tuyeres of a blast furnace, the temperature within the blast furnace can be further increased, and as a result, the reducing agent ratio of the blast furnace can be lowered. With this finding, at least one feature of the present invention was accomplished.

A pulverized coal combustion test through which features of the present invention were made will be described. Nine types of pulverized coal that were different from one another in specific surface area, volatile matter content, and lower heating value were prepared and subjected to a combustion test. Of the nine types of pulverized coal, adjusted coals 1 to 8 were obtained by preparing low-grade coal having a moisture content of 60 mass % and a volatile matter content on a dry basis of 50 mass % and changing the moisture content to 1 mass % or less by subjecting the coal to a heat treatment at a temperature within a range of 500 to 1000° C. for a predetermined length of time. "Dry basis" means a mass obtained by subtracting the amount of moisture included in pulverized coal. The low-grade coal subjected to the heat treatment was pulverized such that, for example, the proportion of fine particles having a particle diameter of 74 μm or less is 80 mass % or more, and the adjusted coals, 1 to 8, among which the specific surface area, the volatile matter content, and the lower heating value were varied, were produced.

The specific surface area, volatile matter content, and lower heating value of each of adjusted coals 1 to 8 were adjusted by performing a heat treatment at a temperature within the range of 500 to 1000° C. By performing a heat treatment at a temperature within the range of 500 to 1000° C., not only moisture but also volatile matter, included in pulverized coal, is released, and thus the volatile matter content of the pulverized coal can be adjusted. By performing a heat treatment at a temperature within the range of 500 to 1000° C., volatile matter, which generate low amounts of heat, and moisture, included in the pulverized coal are reduced to increase the ratio of fixed carbon, which generates high amounts of heat. Thus, the lower heating value of the pulverized coal can be adjusted. By performing a heat treatment at a temperature within the range of 500 to 1000° C. and thereby releasing volatile matter, pores can be formed in the coal and irregularities can be formed on the surface of the coal, and consequently, the specific surface area of the pulverized coal can be adjusted.

The specific surface area of the pulverized coal was measured by a BET method using $N_2$ gas adsorption. The BET method is a method of measuring the amount of gas adsorbed on a powder sample as a function of the pressure of the adsorption gas. When a gas is adsorbed on a powder sample, the relationship denoted by equation (1) exists between an amount Va of adsorbed gas and a pressure P of the adsorption gas in adsorption equilibrium provided that the value $P/P_0$ is within a range of 0.05 to 0.30.

Equation 1

$$\frac{1}{\left\{V_a\left(\frac{P_0}{P}-1\right)\right\}} = \frac{(C-1)}{V_m C} \times \frac{P}{P_0} + \frac{1}{V_m C} \quad (1)$$

Here, in equation (1), P is the adsorption equilibrium pressure (kPa), $P_0$ is the vapor pressure (kPa) of the adsorption gas at a measurement temperature, Va is the adsorption amount (mL) in adsorption equilibrium, Vm is the monolayer adsorption amount (mL), and C is a constant, such as the heat of adsorption or the heat of condensation.

The adsorption amount Va in adsorption equilibrium can be measured by using a flow method or a volumetric method. The flow method is a method of calculating the amount of adsorption by passing, through a sample, a gas mixture including the adsorption gas and a carrier gas for transporting the adsorption gas while contacting the gas mixture with the sample and by determining the change between the concentration of the adsorption gas before the passage and the concentration after the passage. The volumetric method is a method of calculating the amount of adsorption by placing a powder sample in a container whose volume is known and determining the change in pressure in association with the gas adsorption on the surface of the sample. The specific surface area of the powder sample can be calculated by using the monolayer adsorption amount Vm in equation (1)) and applying equation (2).

Equation 2

$$S = \frac{V_m \times N \times a}{m \times 22400} \quad (2)$$

Here, in equation (2), S is the specific surface area ($m^2/g$), N is Avogadro's number, a is the effective cross-sectional area ($m^2$) per molecule of the adsorption gas, and m is the mass (g) of the powder sample.

The volatile matter content of the pulverized coal was calculated by using the following procedure. First, the sample was placed in a crucible including a lid, to be prevented from contacting air, and was then heated at 900° C. for 7 minutes. Next, the reduction in the mass of the sample due to heating was calculated as a percentage, and from this value, the moisture content, which was calculated at the same time, was subtracted. Thus, the volatile matter content was calculated.

The lower heating value of the pulverized coal was calculated by measuring the higher heating value, $H_h$ (MJ/kg), according to JIS M8814 and using the measured higher heating value $H_h$ and applying equation (3).

Equation 3

$$H_1 = H_n - r \times (9H + w) \quad (3)$$

Here, in equation (3), $H_1$ is the lower heating value (MJ/kg), H is the hydrogen content (mass %) in the sample before combustion, w is the moisture content (mass %) in the sample before combustion, and r is the latent heat of condensation (MJ/kg) of moisture.

Coal A is pulverized coal produced by, without performing a heat treatment, performing pulverization such that the proportion of fine particles having a particle diameter of 74 μm or less is 80 mass % or more. Table 1 shows the specific surface area, volatile matter content, and lower heating value of each of coal A and adjusted coals 1 to 4, which were used in the combustion test.

TABLE 1

| Coal type | Coal A | Adjusted coal 1 | Adjusted coal 2 | Adjusted coal 3 | Adjusted coal 4 |
|---|---|---|---|---|---|
| Specific surface area ($m^2/g$) | 0.4 | 1003.5 | 1.2 | 996.4 | 2.1 |
| Volatile matter content (mass %) | 15.4 | 2.8 | 25.8 | 3.8 | 24.8 |
| Lower heating value (KJ/kg) | 30,982 | 32,657 | 27,125 | 32,155 | 27,183 |

As shown in Table 1, there was a tendency that the higher the volatile matter content, the lower the degree of carbonization of coal, which resulted in the smaller lower heating value. In addition, there was a tendency that the higher the volatile matter content, the smaller the specific surface area of coal. Thus, it is seen that inclusion of volatile matter does not affect the formation of pores and surface irregularities in pulverized coal.

The combustion test was conducted by using a combustion experiment apparatus simulating a portion at and near a tuyere of a blast furnace. The apparatus was configured such that the location at which pulverized coal injected through the tuyere via a lance was combusted could be visually observed. The combustion experiment was carried out by injecting each of coal A and adjusted coals 1 to 4 into the combustion experiment apparatus with the injection rate through the tuyere set to 29.8 kg/h (corresponding to 100 kg per ton of pig iron).

The blast conditions for pulverized coal included a blast temperature of 1200° C., a flow rate of 300 $Nm^3/h$, a flow velocity of 70 m/s, and an $O_2$ enrichment amount of 5.5 vol % (an oxygen concentration of 26.5 vol % with respect to an oxygen concentration of 21 vol % in air). $N_2$ was used as the coal carrier gas. Under these test conditions, coal A and adjusted coals 1 to 4 were evaluated in terms of ignitability and combustion temperature. The results are shown in Table 2.

TABLE 2

| | Coal type | Coal A | Adjusted coal 1 | Adjusted coal 2 | Adjusted coal 3 | Adjusted coal 4 |
|---|---|---|---|---|---|---|
| Ignitability | Ignition distance (mm) | 40 | 45 | 37 | 30 | 33 |
| | Ignition time (ms) | 1.0 | 1.1 | 0.9 | 0.7 | 0.8 |
| | Determination | — | x | Δ | ○ | ○ |
| Combustion temperature | Combustion temperature (° C.) | 1520 | 1530 | 1510 | 1570 | 1560 |
| | Determination | — | Δ | x | ○ | ○ |

Ignitability was evaluated based on an ignition distance and an ignition time. The ignition distance is a distance from the tip of the lance to a position at which pulverized coal injected through the lance is ignited. Pulverized coal for which the distance was short was determined to have a high ignitability, and pulverized coal for which the distance was long was determined to have a low ignitability.

The FIGURE is a partial schematic cross-sectional view of a combustion experiment apparatus 10. The FIGURE illustrates a portion where a lance 16 is provided in the combustion experiment apparatus 10. As illustrated in the FIGURE, a tuyere 18 is inserted through a furnace wall 12 of the combustion experiment apparatus 10 into the interior of the combustion experiment apparatus 10. Pulverized coal, together with $N_2$ serving as a carrier gas, is injected into a blow pipe 14 through the lance 16. Pulverized coal injected into the blow pipe 14 is injected, together with oxygen-enriched air, through the tuyere 18 to the high-temperature zone of the combustion experiment apparatus 10 and is ignited. In the FIGURE, an ignition location 20 is a location where pulverized coal injected through the lance 16 into the combustion experiment apparatus 10 is ignited. A distance a in the FIGURE is a distance from the tip of the tuyere 18 to the ignition location 20 and corresponds to the ignition distance in Table 2.

Likewise, the ignition time is time that elapses until pulverized coal injected through the tip of the tuyere 18 into the combustion experiment apparatus 10 is ignited in the combustion experiment apparatus 10. Pulverized coal for which the time was short was determined to be pulverized coal having a high ignitability, and pulverized coal for which the time was long was determined to be pulverized coal having a low ignitability. In the row "Determination" in Table 2, "x" means having a lower ignitability than coal A, "Δ" means having similar ignitability to coal A, and "O" means having a higher ignitability than coal A.

As shown in Table 2, adjusted coal 1 had a longer ignition distance and a longer ignition time than coal A and had a lower ignitability than coal A. Adjusted coal 2 had a slightly shorter ignition distance and a slightly shorter ignition time than coal A, but, since the difference was very small, adjusted coal 2 was determined to be similar to coal A. On the other hand, adjusted coal 3 and adjusted coal 4 had a shorter ignition distance and a shorter ignition time than coal A and thus had a higher ignitability than coal A.

The combustion temperature is a temperature at which pulverized coal is combusted. Pulverized coal having a combustion temperature higher than the combustion temperature of coal A was determined to be "O", pulverized coal having a combustion temperature similar to the combustion temperature of coal A was determined to be "Δ", and pulverized coal having a combustion temperature lower than the combustion temperature of coal A was determined to be "x". In the combustion test described above, the combustion temperature of the pulverized coal was measured by using a two-color pyrometer.

As shown in Table 2, adjusted coal 1 had a higher combustion temperature than coal A but the difference was very small, and thus adjusted coal 1 was determined to be similar to coal A. Furthermore, adjusted coal 2 had a lower combustion temperature than coal A and was determined to be pulverized coal having a lower combustion temperature than coal A. On the other hand, adjusted coal 3 and adjusted coal 4 had higher combustion temperatures than coal A and were determined to be pulverized coal having higher combustion temperatures than coal A.

Here, the results in Table 2 are examined in view of the specific surface area, volatile matter content, and lower heating value of each of coal A and adjusted coals 1 to 4, shown in Table 1. It is believed that ignitability is affected by the specific surface area and the volatile matter content of pulverized coal. In a comparison between adjusted coal 1 and adjusted coal 3, ignitability was improved because of an increase in volatile matter content of the pulverized coal from 2.8 mass % to 3.8 mass %. This is believed to be because inclusion of large amounts of volatile matter, which is combusted at a lower temperature than coal is, lowered the ignition temperature, which in turn improved ignitability. In a comparison between adjusted coal 2 and adjusted coal 4, ignitability was improved because of an increase in specific surface area from 1.2 $m^2/g$ to 2.1 $m^2/g$. This is believed to be because, as the specific surface area of the coal increased, the amount of heat received by the pulverized coal from the surroundings per unit time increased and contact properties with respect to oxygen around the pulverized coal were improved, which in turn improved ignitability. Based on the experiment described above, in accordance with an embodiment of the present invention, the specific surface area of adjusted pulverized coal was specified to be within the range of 2 $m^2/g$ or more and 1000 $m^2/g$ or less, and the volatile matter content was specified to be within the range of 3 mass % or more and 25 mass % or less. By ensuring that pulverized coal has a surface area within the range of 2 $m^2/g$ or more and 1000 $m^2/g$ or less and a volatile matter content within the range of 3 mass % or more and 25 mass % or less, the ignitability of the pulverized coal can be improved compared with pulverized coal having a specific surface area and/or a volatile matter content outside the ranges described above. A specific surface area outside the range of 2 $m^2/g$ or more and 1000 $m^2/g$ or less means that the specific surface area is less than 2 $m^2/g$ or greater than 1000 $m^2/g$.

On the other hand, increasing the specific surface area of pulverized coal to greater than 1000 $m^2/g$ is not desirable because, in such a case, an amount of volatile matter is to be released corresponding to the value of the specific surface area, and thus the decrease in ignitability due to a reduction in volatile matter is predominant over the ignitability improvement effect due to the increase in specific surface area, and consequently the pulverized coal as a whole has a reduced ignitability. Furthermore, inclusion of volatile matter in an amount of greater than 25 mass % is not desirable because such a case means that volatile matter remains unreleased from pulverized coal, and thus the specific surface area does not increase and the ignitability of the pulverized coal as a whole attributable to volatile matter and the specific surface area is no better than the ignitability of coal A.

It is believed that the combustion temperature is affected by ignitability and the lower heating value. Specifically, in a comparison between adjusted coal 1 and adjusted coal 2, the lower heating value of adjusted coal 1 was greater than that of adjusted coal 2, and as a result, the combustion temperature. of adjusted coal 1 was higher than that of adjusted coal 2. On the other hand, in a comparison between adjusted coal 1 and adjusted coal 4, although the lower heating value of adjusted coal 4 was smaller than that of adjusted coal 1, the combustion temperature of adjusted coal 4 was higher than that of adjusted coal 1. This is believed to be due to the influence of the ignitability of adjusted coal 4 being higher than that of adjusted coal 1. That is, when ignitability is low, the combustion temperature is low even in the case that the lower heating value is large. Based on the experiment described above, in accordance with an embodiment of the present invention, the lower heating value of adjusted pulverized coal is specified to be 27170 kJ/kg or more. By ensuring that the lower heating value of adjusted pulverized coal is 27170 kJ/kg or more, the combustion temperature during combustion of the pulverized coal can be increased, as compared with pulverized coal having a lower heating value of less than 27170 kJ/kg. Since the combustion temperature increases as the lower heating value increases, the upper limit of the lower heating value may not be particularly specified. However, since the heating value of 100% carbon is 32750 kJ/kg, the upper limit of the lower heating value may be equal to or less than this value.

Table 3 shows the specific surface area, volatile matter content, and lower heating value of each of coal A and adjusted coals 5 to 8, which were used in the combustion test.

TABLE 3

| Coal type | Coal A | Adjusted coal 5 | Adjusted coal 6 | Adjusted coal 7 | Adjusted coal 8 |
|---|---|---|---|---|---|
| Specific surface area ($m^2/g$) | 0.4 | 810.0 | 95.0 | 800.0 | 110.0 |
| Volatile matter content (mass %) | 15.4 | 3.0 | 22.0 | 4.0 | 21.0 |
| Lower heating value (KJ/kg) | 30,982 | 32,100 | 29,000 | 32,000 | 30,000 |

The ignitabilities and the combustion temperatures of adjusted coals 5 to 8, shown in Table 3, were evaluated under the same test conditions as in Table 2. The results are shown in Table 4.

TABLE 4

| Coal type | | Coal A | Adjusted coal 5 | Adjusted coal 6 | Adjusted coal 7 | Adjusted coal 8 |
|---|---|---|---|---|---|---|
| Ignitability | Ignition distance (mm) | 40 | 28 | 28 | 26 | 26 |
| | Ignition time (ms) | 1.0 | 0.6 | 0.6 | 0.5 | 0.5 |
| | Determination | — | ○ | ○ | ◎ | ◎ |
| Combustion temperature | Combustion temperature (° C.) | 1520 | 1580 | 1575 | 1590 | 1585 |
| | Determination | — | ○ | ○ | ◎ | ◎ |

In the row "Determination" of Ignitability in Table 4, "O" means having a higher ignitability than coal A, and "⊙" means having a significantly higher ignitability than coal A. As shown in Table 4, adjusted coals 5 and 6 both had shorter ignition distances and shorter ignition times than coal A and were thus determined to have higher ignitabilities than coal A. Adjusted coals 7 and 8 both had significantly shorter ignition distances and significantly shorter ignition times than coal A and were thus determined to have significantly higher ignitabilities than coal A.

In the row "Determination" of Combustion temperature in Table 4, "O" means that the pulverized coal has a higher combustion temperature than coal A, and "⊙" means that the pulverized coal has a significantly higher combustion temperature than coal A. As shown in Table 4, adjusted coals 5 and 6 both had higher combustion temperatures than coal A and were thus determined to be pulverized coal having higher combustion temperatures than coal A. Adjusted coals 7 and 8 both had significantly higher combustion temperatures than coal A and were thus determined to be pulverized coals having significantly higher combustion temperatures than coal A.

The experiment described above demonstrates that it is more preferable that the adjusted pulverized coal have a specific surface area within the range of 110 $m^2/g$ or more and 800 $m^2/g$ or less, a volatile matter content within the range of 4 mass % or more and 21 mass % or less, and a lower heating value of 30000 kJ/kg or more, and as a result, the combustion temperature of the pulverized coal is further increased.

As described above, the ignitability of pulverized coal is affected by the specific surface area and the volatile matter content of the pulverized coal. In addition, the combustion temperature of pulverized coal is affected by the ignitability and the lower heating value of the pulverized coal. That is, it is seen that the specific surface area, volatile matter content, and lower heating value of pulverized coal, in association with one another, not independently of one another, enables an increase in the combustion temperature of the pulverized coal. Thus, by injecting, through tuyeres of a blast furnace, adjusted pulverized coal having a specific surface area within the range of 2 $m^2/g$ or more and 1000 $m^2/g$ or less, a volatile matter content within the range of 3 mass % or more and 25 mass % or less, and a lower heating value of 27170 kJ/kg or more and therefore having a high ignitability and an increased combustion temperature, the temperature within the blast furnace can be increased compared with the case of injecting pulverized coal having a combustion temperature that is not increased. As a result, sufficient furnace heat for the blast furnace is ensured, which makes it possible to lower the reducing agent ratio in the operation of the blast furnace and consequently achieves a reduction in the amount of coke to be charged from the top of the blast furnace.

Furthermore, it is also possible that pulverized coal having a low ignitability and a combustion temperature that is not increased may be mixed with adjusted pulverized coal having a high ignitability and an increased combustion temperature as described above, and such mixed pulverized coal may be injected through tuyeres of a blast furnace. At least 10 mass % adjusted pulverized coal having a high ignitability and an increased combustion temperature may be mixed with a pulverized coal having a combustion temperature that is not increased. When the mixing ratio is increased, a higher amount of adjusted pulverized coal having a high ignitability and an increased combustion temperature is mixed, which further contributes to increase the temperature within the blast furnace. Hence, it is desirable that the mixing ratio of adjusted pulverized coal having a high ignitability and an increased combustion temperature be high, and thus the upper limit of the mixing ratio of adjusted pulverized coal is a mixing ratio of 100 mass %, which provides pulverized coal to be injected entirely made of adjusted pulverized coal. The pulverized coal having a combustion temperature that is not increased is, for example, pulverized coal having at least one of the following: a specific surface area outside the range of 2 $m^2/g$ or more and 1000 $m^2/g$ or less, a volatile matter content outside the range of 3 mass % or more and 25 mass % or less, and a lower heating value of less than 27170 kJ/kg.

In the above-described pulverization process for adjusted coals 1 to 8, the pulverization process is carried out such that the proportion of fine particles having a particle diameter of 74 μm or less is 80 mass % or more. However, the process is not limited to this. The pulverization process is not particularly limited provided that adjusted pulverized coal adjusted to at least have a specific surface area within the range of 2 $m^2/g$ or more and 1000 $m^2/g$ or less, a volatile matter content within the range of 3 mass % or more and 25 mass % or less, and a lower heating value of 27170 kJ/kg or more is obtained. Similarly, in the combustion test described above, an example in which coal is subjected to a heat treatment prior to pulverization is described, but this is non-limiting. It may be unnecessary to perform a heat treatment provided that adjusted pulverized coal at least having a specific surface area within the range of 2 $m^2/g$ or more and 1000 $m^2/g$ or less, a volatile matter content within the range of 3 mass % or more and 25 mass % or less, and a lower heating value of 27170 kJ/kg or more is obtained.

Example 1

Example 1 will be described. In Example 1, a blast furnace equipped with 38 tuyeres was used, and blast furnace operations were performed, each by injecting coal A, adjusted coal 1, 2, 3, or 4. The blast furnace operations were each performed while injecting, through the tuyeres of the blast furnace via lances, coal A, adjusted coal 1, 2, 3, or 4. Each of the blast furnace operations was performed for three days, the blast furnace having an internal volume of 5000 $m^3$, under the following conditions. The target pig iron production volume was 11500 t/day, the pulverized coal ratio was 150 kg/t-pig iron, the blast temperature was 1200° C., and the $O_2$ enrichment was 5.5 vol %. For coal A and adjusted coals 1 to 4, the average coke ratio (kg/t-pig iron) over three days was calculated. The results are shown in Table 5.

TABLE 5

| Coal type | Coal A | Adjusted coal 1 | Adjusted coal 2 | Adjusted coal 3 | Adjusted coal 4 |
|---|---|---|---|---|---|
| Coke ratio (kg/t-pig iron) | 380 | 383 | 387 | 373 | 375 |

In Table 5, adjusted coal 3 and adjusted coal 4 are invention examples, coal A is a related-art example, and adjusted coal 1 and adjusted coal 2 are comparative examples. As shown in Table 5, adjusted coal 1 or 2 resulted in an increase in the coke ratio in comparison with coal A, and thus no lowering effect was exerted on the coke ratio, which is a reducing agent ratio. Adjusted coal 1 had a lower ignitability than coal A and adjusted coal 2 had a lower combustion temperature than coal A, and consequently, the temperature within the blast furnace, in the case where adjusted coal 1 or 2 was injected through the tuyeres of the blast furnace, was lower than in the case where coal A was injected. Thus, it was necessary to increase the temperature within the blast furnace and, as a result, the amount of coke used increased.

On the other hand, adjusted coal 3 or 4 provided a lowering of the coke ratio, which is the reducing agent ratio, in comparison with coal A. Adjusted coals 3 and 4 had higher ignitabilities and higher combustion temperatures than coal A, and consequently, the temperature within the blast furnace, in the case where adjusted coal 3 or 4 was injected through the tuyeres of the blast furnace, was higher than in the case where coal A was injected. As a result, the amount of coke used, which was charged from the top of the blast furnace, was reduced. Thus, it was observed that adjusted coal 3 and adjusted coal 4, which had high ignitabilities and increased combustion temperatures, enabled lowering of the reducing agent ratios of the blast furnace and thus reduced the amounts of coke to be charged from the top of the blast furnace.

Next, adjusted coals 3 and 4 were each mixed with coal A, each at predetermined ratios (5 mass %, 10 mass %, 20 mass %, and 50 mass %), and thus coal mixtures were prepared. Operations of injecting the coal mixture into a blast furnace were performed, for three days for each, by using the same blast furnace and the same operation conditions as described above, and the average coke ratio (kg/t-pig iron) was calculated. Table 6 shows the mixing ratios of adjusted coal 3 and the calculated average coke ratios. Furthermore, Table 7 shows the mixing ratios of adjusted coal 4 and the calculated average coke ratios.

TABLE 6

| | Adjusted coal 3 Mixing ratio (mass %) | | | | | |
|---|---|---|---|---|---|---|
| | 0 | 5 | 10 | 20 | 50 | 100 |
| Coke ratio (kg/t-pig iron) | 380 | 380 | 379 | 378 | 376 | 373 |

TABLE 7

| | Adjusted coal 4 Mixing ratio (mass %) | | | | | |
|---|---|---|---|---|---|---|
| | 0 | 5 | 10 | 20 | 50 | 100 |
| Coke ratio (kg/t-pig iron) | 380 | 380 | 379 | 378 | 377 | 375 |

As shown in Table 6 and Table 7, a mixing ratio of 10 mass % or more, either for adjusted coal 3 or for adjusted coal 4, enabled lowering of the coke ratio. Adjusted coal 3 and adjusted coal 4 had large specific surface areas and high volatile matter contents and, as a result, were ignited sooner than coal A. The heat of combustion due to the ignition is transferred to coal A. It is believed that this increased the combustion temperature of the coal mixture as a whole and consequently increased the temperature within the blast furnace. From the results, it was observed that lowering of the coke ratio, which is the reducing agent ratio, can be achieved by mixing 10 mass % or more of coal 3 or 4 with coal A, coal A being pulverized coal having a low ignitability and a combustion temperature that is not increased. Adjusted coals 3 and 4 are each adjusted pulverized coals adjusted to have specific surface areas within the range of 2 $m^2/g$ or more and 1000 $m^2/g$ or less, volatile matter contents within the range of 3 mass % or more and 25 mass % or less, and lower heating values of 27170 kJ/kg or more. Thus, coal A, which had a low ignitability and a combustion temperature that was not increased, was also effectively utilized.

Example 2

Example 2 will be described. In Example 2, a blast furnace equipped with 38 tuyeres was used, and blast furnace operations were performed, each by injecting adjusted coal 5, 6, 7, or 8. The blast furnace operations were each performed while injecting, through the tuyeres of the blast furnace via lances, coal A, adjusted coal 5, 6, 7, or 8. Each of the blast furnace operations was performed for three days, the blast furnace having an internal volume of 5000 $m^3$, under the following conditions. The target pig iron production volume was 11500 t/day, the pulverized coal ratio was 150 kg/t-pig iron, the blast temperature was 1200° C., and the $O_2$ enrichment was 5.5 vol %. For coal A and adjusted coals 5 to 8, the average coke ratio (kg/t-pig iron) over three days was calculated. The results are shown in Table 8.

TABLE 8

| Coal type | Coal A | Adjusted coal 5 | Adjusted coal 6 | Adjusted coal 7 | Adjusted coal 8 |
|---|---|---|---|---|---|
| Coke ratio (kg/t-pig iron) | 380 | 372 | 372 | 369 | 370 |

In Table 8, adjusted coals 5 to 8 are invention examples, and coal A is a related-art example. As shown in Table 8, each of adjusted coals 5 to 8 provided a lowering of the coke ratio, which is the reducing agent ratio, in comparison with coal A. All of adjusted coals 5 to 8 had higher ignitabilities and higher combustion temperatures than coal A, and consequently, the temperature within the blast furnace, in the case where any of adjusted coals 5 to 8 was injected through the tuyeres of the blast furnace, was higher than in the case where coal A was injected. As a result, the amount of coke used, which was charged from the top of the blast furnace, was reduced. It was observed that, in particular, adjusted coals 7 and 8, each of which was pulverized coal having a significantly higher ignitability than coal A and having a significantly higher combustion temperature than coal A, provided a significant reduction in the amount of coke to be charged from the top of the blast furnace.

From these, it was observed that it is more desirable to use adjusted coal 7 or adjusted coal 8, which is pulverized coal adjusted to have a specific surface area within the range of 110 $m^2/g$ or more and 800 $m^2/g$ or less, a volatile matter content within the range of 4 mass % or more and 21 mass % or less, and a lower heating value of 30000 kJ/kg or more and that, by injecting, through tuyeres of a blast furnace, adjusted pulverized coal adjusted to be within the ranges, further lowering of the coke ratio, which is the reducing agent ratio, can be achieved and thus the amount of coke to be charged from the top of the blast furnace can be significantly reduced.

Next, adjusted coals 7 and 8 were each mixed with coal A, each at predetermined ratios (5 mass %, 10 mass %, 20 mass %, and 50 mass %), and thus coal mixtures were prepared. Operations of injecting the coal mixture into a blast furnace were performed, for three days for each, by using the same blast furnace and the same operation conditions as described above, and the average coke ratio (kg/t-pig iron) was calculated. Table 9 shows the mixing ratios of adjusted coal 7 and the calculated average coke ratios. Table 10 shows the mixing ratios of adjusted coal 8 and the calculated average coke ratios.

TABLE 9

| | Adjusted coal 7 Mixing ratio (mass %) | | | | | |
|---|---|---|---|---|---|---|
| | 0 | 5 | 10 | 20 | 50 | 100 |
| Coke ratio (kg/t-pig iron) | 380 | 379 | 379 | 378 | 375 | 369 |

TABLE 10

| | Adjusted coal 8 Mixing ratio (mass %) | | | | | |
|---|---|---|---|---|---|---|
| | 0 | 5 | 10 | 20 | 50 | 100 |
| Coke ratio (kg/t-pig iron) | 380 | 380 | 379 | 378 | 375 | 370 |

As shown in Table 9, for adjusted coal 7, a mixing ratio of 5 mass % or more enabled lowering of the coke ratio. As shown in Table 10, for adjusted coal 8, a mixing ratio of 10 mass % or more enabled lowering of the coke ratio. Thus, it was observed that lowering of the coke ratio, which is the reducing agent ratio, can be achieved by mixing 10 mass % or more of coal 7 or 8 with coal A, coal A being pulverized coal having a low ignitability and a combustion temperature that is not increased. Adjusted coals 7 and 8 are each adjusted pulverized coals adjusted to have specific surface areas within the range of 110 $m^2/g$ or more and 800 $m^2/g$ or less, volatile matter contents within the range of 4 mass % or more and 21 mass % or less, and lower heating values of 30000 kJ/kg or more.

REFERENCE SIGNS LIST

10 combustion experiment apparatus
12 furnace wall
14 blow pipe
16 lance
18 tuyere
20 ignition location

The invention claimed is:

1. A blast furnace operation method including injecting pulverized coal through tuyeres of a blast furnace, the method comprising:

adjusting coal containing moisture and volatile matter to form adjusted pulverized coal having a specific surface area within a range of 110 $m^2/g$ or more and 800 $m^2/g$ or less, a lower heating value of 27170 Id/kg or more, and a volatile matter content within a range of 3 mass % or more and 25 mass % or less; and injecting, through the tuyeres of the blast furnace, pulverized coal in which the adjusted pulverized coal is mixed in a mixing ratio of 10 mass % or more.

2. A blast furnace operation method including injecting pulverized coal through tuyeres of a blast furnace, the method comprising:

adjusting coal containing moisture and volatile matter to form adjusted pulverized coal having a specific surface area within a range of 110 $m^2/g$ or more and 800 $m^2/g$ or less, a lower heating value of 30000 Id/kg or more, and a volatile matter content within a range of 4 mass % or more and 21 mass % or less; and injecting, through the tuyeres of the blast furnace, pulverized coal in which the adjusted pulverized coal is mixed in a mixing ratio of 10 mass % or more.

* * * * *